US005389502A

United States Patent [19]

Fitterman et al.

[11] Patent Number: 5,389,502

[45] Date of Patent: Feb. 14, 1995

[54] HARDENING DEVELOPER FOR SILVER HALIDE PHOTOGRAPHY AND DEVELOPMENT METHOD

[75] Inventors: Alan S. Fitterman, Rochester; Jean M. Buongiorne, Brockport, both of N.Y.

[73] Assignee: Eastman Kodak Company, Rochester, N.Y.

[21] Appl. No.: 193,350

[22] Filed: Feb. 8, 1994

[51] Int. Cl.[6] ..... G03C 5/305

[52] U.S. Cl. ..... 430/491; 430/264; 430/265; 430/266; 430/268; 430/438; 430/464; 430/481

[58] Field of Search ..... 430/264, 265, 266, 268, 430/438, 439, 440, 444, 464, 481, 482, 491, 966

[56] References Cited

U.S. PATENT DOCUMENTS

| | | | |
|---|---|---|---|
| 3,201,246 | 8/1965 | Allen et al. | 430/456 |
| 3,545,971 | 12/1970 | Barnes et al. | 430/355 |
| 3,994,729 | 11/1976 | Shibaoka | 430/420 |
| 4,040,833 | 8/1977 | Hinata et al. | 430/139 |
| 4,078,932 | 3/1978 | Hazenbosch et al. | 430/244 |
| 4,672,025 | 6/1987 | Yamada et al. | 430/420 |
| 4,756,997 | 7/1988 | Marchesano | 430/264 |

FOREIGN PATENT DOCUMENTS

| | | | |
|---|---|---|---|
| 574802 | 4/1959 | Canada | 430/491 |

*Primary Examiner*—Hoa Van Le
*Attorney, Agent, or Firm*—Robert Luke Walker

[57] ABSTRACT

An alkaline, aqueous black-and-white photographic developer and developing method. The developer includes hydroquinone developing agent, auxiliary developing agent, dialdehyde hardener, organic antifoggant, sulfite antioxidant, buffer, and sequestering agent selected from the group consisting of oligomeric carboxylic acid substituted hydrocarbons.

20 Claims, No Drawings

HARDENING DEVELOPER FOR SILVER HALIDE PHOTOGRAPHY AND DEVELOPMENT METHOD

FIELD OF THE INVENTION

The invention relates to hardening developers for processing silver halide photographic material and to development methods. More particularly, the invention relates to an alkaline black-and-white hardening developer for processing a silver halide radiographic material and a development method utilizing that developer.

BACKGROUND OF THE INVENTION

In silver halide photography, a latent image is formed in the silver halide emulsion layer of a photographic element by image-wise exposing the emulsion layer to radiation. The exposure step is followed by development, fixing, washing and drying steps. Radiographic elements, that is, photographic elements used in radiography, are commonly processed in automatic processing machines in which the element is guided from one processing station to another. In these machines loss of activity of the processing solution is counteracted by continual or periodic replenishment of processing solutions. Processing, in these automatic machines is generally conducted at elevated temperatures, in excess of 30° C., to reduce processing time. Emulsions used for radiographic elements usually have a low ratio of binder, such as gelatin, to silver halide. A hardening developer is used with these elements to avoid softening and excessive swelling of the emulsions. Hardening developers must provide rapid development since as emulsion layers harden, permeability decreases.

Sequestering agents are used in photographic developers to counteract the effect of soluble salts or trace metal impurities that may be present. Such impurities may originate in the developer itself or may be introduced from the environment during use of the developer solution. Common impurities are calcium, iron, and copper ions. Calcium can precipitate in the developer resulting in particulate contamination. Iron and copper can catalyze the oxidation of hydroquinone or the like, resulting in a degradation of developer stability. These effects are particularly undesirable in developers used in radiography.

Radiographic developers generally have pH values in the range of about 9–11. Development is accelerated at higher pH levels, however, so is developer breakdown associated with oxidation.

Sequestering agents typically function by forming stable complexes with metal ion impurities; thus reducing the concentration of free metal ion impurities to acceptable levels. These complexes are classified in *Photographic Processing Chemistry*, L.F.A. Mason, Focal Press, London, (1975) pp. 55–67, by structure into three main groups: complex phosphates, hydroxyacids, and nitrogenous carboxylic acids.

Complex phosphates are good sequestering agents for calcium and magnesium ions at high pH, but as a class have limited stability in alkaline solution.

Hydroxyacids have limited use in developer solutions since they are poor calcium sequestering agents and have poor sequestering power at high pH.

Nitrogenous carboxylic acids do not have the same limitations as complex phosphates and hydroxyacids. Although some nitrogenous carboxylic acid sequestering agents have the shortcomings of forming stable complexes with silver ions and having limited thermal stability, many nitrogenous carboxylic acids have been widely used in developers (see U.S. Pat. No. 3,201,246). This class of sequestering agents includes triacetic acid compounds (see, for example, U.S. Pat. No. 4,040,833), tetraacetic acid derivatives (see, for example, U.S. Pat. No. 3,994,729), and other more complex derivatives (see, for example, U.S. Pat. No. 4,672,025). Specific examples of nitrogenous carboxylic acid sequestering agents include: iminodiacetic acid, methyliminodiacetic acid, hydroxyethyliminoacetic acid, carboxyethyliminodiacetic acid, nitrilotriacetic acid, ethylendiaminetetraacetic acid, glycol ether diaminetetraacetic acid, 1,3-diamino-2-propanoltetraacetic acid, diethylenetriaminepentaacetic acid, and triethylenetetraminehexaacetic acid.

Hydrolyzed polymaleic anhydride is marketed commercially for use as a calcium carbonate inhibitor in photoprocessing solutions, especially chromogenic color developer solutions. Hydrolyzed polymaleic anhydride is available from the Additives Division of Ciba-Geigy Corporation, Hawthorne, N.Y., under the trademark Irgaform 3000. This material is also available under the trademeark Belclene 200 from the same source. Hydrolyzed polymaleic anhydride is a liquid having a pH of about 1, which is neutralized by alkali with the evolution of heat.

It is desirable to provide an alkaline hardening developer which includes a sequestrant that has good stability at the pH of the developer, is a good sequestering agent for calcium and other metals such as iron, and, at least under optimal conditions, does not cause adverse sensitometric effects upon radiographic elements developed in an automatic processor. It is also desirable to provide a development method utilizing that developer.

SUMMARY OF THE INVENTION

The invention, in its broader aspects, provides an alkaline, aqueous black-and-white photographic developer and developing method. The developer includes hydroquinone developing agent, auxiliary developing agent, dialdehyde hardener, organic antifoggant, sulfite antioxidant, buffer, and sequestering agent selected from the group consisting of oligomeric carboxylic acid substituted hydrocarbons.

It is an advantageous effect of at least some of the embodiments of the invention that an alkaline hardening developer and development method are provided, in which a developer includes a sequestrant that has good stability at the pH of the developer, is a good sequestering agent for calcium and other metals such as iron, and, at least under optimal conditions, does not cause adverse sensitometric effects upon radiographic elements developed in an automatic processor.

DESCRIPTION OF PARTICULAR EMBODIMENTS

The photographic developer of the invention comprises: (a) a hydroquinone developing agent, (b) an auxiliary developing agent, (c) a dialdehyde hardener, (d) an organic antifoggant, (e) a sulfite antioxidant, (f) a multimeric carboxylic acid sequestering agent, and (g) a buffer. The multimeric carboxylic acid sequestering agent is selected from the group consisting of oligomers having repeating units having the general structure

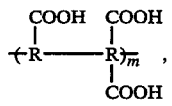

in which R is ethyl, propyl, or butyl, and m is from about 1 to 10. The term "oligomer" is used herein to broadly designate multimeric molecules having relatively low molecular weights, including material which could be designated "polymers". Currently prefered embodiments of the invention utilize multimeric carboxylic acid sequestering agents having a molecular weight of less than about 1000. In a currently preferred embodiment of the invention, this sequestering agent is an oligomer or polymer having an $-(AB)_n-$ type repeating unit in which A is a repeating unit selected from the group consisting of

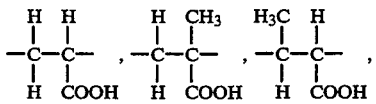

and

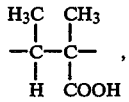

and B is a repeating unit selected from the group consisting of

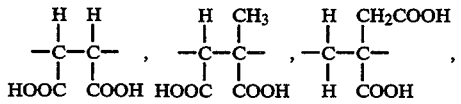

and

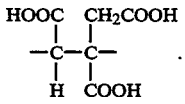

The molecular weight, in this embodiment is less than about 1000.

The hydroquinone developing agent consists of one or more hydroquinone-type compounds. Suitable compounds include: hydroquinone, t-butylhydroquinone, methylhydroquinone, dimethylhydroquinone, chlorohydroquinone, dichlorohydroquinone, bromohydroquinone, isopropylhydroquinone, 1,4-dihydronaphthalene, methoxyhydroquinone, ethoxyhydroquinone, hydroquinone monosulfonate, and hydroquinone disulfonate. A suitable range of concentrations for the hydroquinone agent is from about 0,075 to 0.75 moles per liter of developer, or more preferably from about 0.10 to 0.50 moles per liter of developer.

The auxiliary developing agent consists of one or more compounds, such as 3-pyrazolidinones or aminophenols which provide a superadditive developing effect in combination with the hydroquinone agent. Suitable compounds include: 1-phenyl-3-pyrazolidinone, 1-phenyl-4-phenyl-3-pyrazolidinone, 1-phenyl-4,4-dimethyl-3-pyrazolidinone, 1-phenyl-4-methyl-3-pyrazolidinone, 1-phenyl-5-methyl-3-pyrazolidinone, 4-methyl-1-phenyl-3-pyrazolidinone, 4,4'-dimethyl-1-phenyl-3-pyrazolidinone, o-aminophenol, p-aminophenol, N-methyl-p-aminophenol, N-methyl-o-aminophenol, and 2,4-diaminophenol. A suitable range of concentrations for the auxiliary developing agent is from about $3\times10^{-4}$ to 0.15 moles per liter of developer, or more preferably from about $3\times10^{-3}$ to 0.1 moles per liter of developer.

The dialdehyde hardener is a glutaraldehyde-type compound or mixture of compounds. Useful dialdehydes include aliphatic compounds having aldehyde functional groups separated by a chain of 2–3 carbons or 2–3 carbons and an oxygen linkage. Suitable compounds include glutaraldehyde, α-methylglutaraldehyde, β-methylglutaraldehyde, maleic dialdehyde, succindialdehyde, methylsuccindialdehyde, methoxysuccindialdehyde, α-butoxy-glutaraldehyde, α-methyl-β-ethoxyglutaraldehyde, α-methoxy-β-ethoxyglutaraldehyde, α-n-butoxyglutaraldehyde, α,α-dimethylglutaraldehyde, α,α-dimethoxysuccindialdehyde, β-isopropylsuccindialdehyde, α,α-diethylsuccindialdehyde, butylmaleic dialdehyde, and β-isopropoxysuccindialdehyde. A suitable range of concentrations for the dialdehyde hardener is from about $1\times10^{-3}$ to 0.3 moles per liter of developer, or more preferably from about 0.01 to 0.1 moles per liter of developer.

The organic antifoggant is compound or mixture of compounds which controls the fog appearance in the processed materials. Suitable antifoggants include benzimidazole-, benzotriazole-, mercaptoazole-, indazole-, and mercaptothiadiazole-type antifoggants. Suitable compounds include: 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-(2-mercapto-1,3,4-thiadiazol-2-yl-thio)butanesulfonate, 5-amino-1,3,4-thiadiazole-2-thiol, 5-methylbenzotriazole, 1-phenyl-5-mercaptotetrazole, and benzotriazole. A suitable range of concentrations for the antifoggant is from about 0.01 to 10 mmoles per liter of developer, or more preferably from about 0.1 to 2 mmoles per liter of developer.

The sulfite antioxidant consists of one or more compounds capable of generating sulfite ion, $SO_3^{2-}$, in aqueous solutions. Such compounds include sulfites, bisulfites, metabisulfites, and aldehydebisulfite adducts. The latter compounds constitute both dialdehyde hardener and sulfite antioxidant. Suitable sulfite antioxidants include sodium sulfite, sodium bisulfite, sodium metabisulfite, potassium sulfite, potassium bisulfite, potassium metabisulfite and ammonium metabisulfite. The total amount of sulfite ions supplied by the sulfite antioxidant is greater than 0.05 moles per liter of developer, or more preferably, from 0.1 to 1.25 moles per liter of developer. The molar ratio of sulfite ions to hydroquinone agent is greater than 2:1, or more preferably, from 2.5:1 to 4:1.

The buffer includes a variety of components, most of which have pH related effects. Classes of components include buffering agent, such as carbonates, boric acid, borate salts, and alkanolamines; and alkaline agents, such as KOH, NaOH, LiOH, and sodium and potassium carbonates. The buffering agent, in a currently preferred embodiment of the invention, has a molar ratio relative to the sulfite ions supplied by the sulfite antioxidant of greater than 0.5:1 (moles of buffering agent:moles of sulfite ions), or more preferably from 1:1 to 2:1. The developer of the invention has a preferred pH of from about 9 to 11.

Additional components of the buffer, in particular embodiments of the invention, include dissolving aids, such as polyethylene glycols or polyethylene glycol esters; pH adjusting agents such as organic acids like acetic acid; development accelerators such as pyridiminium compounds, and polyethylene glycols; surface active agents; dispersing agents for eluted silver colloids, such as mercapto compounds; restrainers, such as potassium bromide or sodium bromide; and additional sequestering agents. Examples of additional sequestering agents include aminopolycarboxylic acids like ethylenediaminotetraacetic acid and diethylenetriaminepentaacetic acid, aminopolyphosphonic acids like methylaminophosphonic acid, polyphosphate compounds like sodium hexametaphosphate, α-hydroxycarboxylic acid compounds like lactic acid, dicarboxylic acid compounds like malonic acid, α-ketocarboxylic acid compounds like pyruvic acid, and alkanolamine compounds like diethanolamine.

The developer of the invention is prepared by dissolving the ingredients in water and adjusting the pH to the desired value. The developer may also be prepared in a concentrated form and then diluted to a working strength just prior to use. The developer may be prepared in two or more concentrated parts to be combined and diluted with water to the desired strength and placed in the developing tank of an automatic processing machine.

The developer of the present invention is particularly useful when processing is carried out in an automatic processing machine, such as the device described in U.S. Pat. No. 3,545,971. Suitable processing machines are sold by Eastman Kodak Company of Rochester, N.Y., under the trademark "X-OMAT".

Developing temperature and developing time are dependent upon each other and upon the total processing time. In a particular embodiment of the invention, the development temperature is from about 20° to 50° C. and the development time is from 10 seconds to 1.5 minutes.

After development in the developer of the invention, the radiographic material is fixed, washed and dried in a manner well known to those skilled in the art. Any of a variety of fixing solutions, well known to those skilled in the art, can be used. In a particular embodiment of the invention, the fixing solution is an aqueous solution containing thiosulfate ions and ammonium ions, and, optionally, a water-soluble aluminum compound and one or more of the following acids or their salts: tartaric acid, citric acid, gluconic acid, boric acid.

The fixing solution desirably has a pH of from about 3.8 to about 7.0 at 20° C. The water soluble aluminum compound is added if a hardener is desired. Suitable aluminum compounds include aluminum chloride, and aluminum sulfate. A suitable concentration of thiosulfate and ammonium ions in the fixing solution is from about 0.1 to 5 moles per liter. A suitable concentration for the tartaric acid or other acid or salt is at least $5\times10^{-3}$ moles per liter of fixing solution, or more preferably, from $1.5\times10^{-2}$ to $5\times10^{-2}$ moles per liter of fixing solution.

In an automatic processor in which developer is carried over into the fixing solution, it may be desirable to have the initial pH of the fixing solution from about 3.8 to 5.0; unless other provision is made for maintaining the pH of the fixing solution within a suitable range.

The fixing solution may optionally include a preservative such as sulfite or bisulfite, a pH buffering agent such as boric acid, a pH adjusting agent such as acetic acid and a sequestering agent. Suitable fixing temperatures and times are in the same range as developing temperatures and times.

After fixation, the radiographic material is washed to remove silver salt dissolved by the fixation. Suitable washing temperatures and times are in the same range as fixing and developing temperatures and times.

Preferred silver halide photographic materials for use with the developer of the invention are black-and-white radiographic materials of high gradation or contrast. A preferred gradation is from 1.5 to 4.0. The photographic elements have a support with one or both sides coated with a silver halide emulsion layer. The emulsion comprises actinic radiation sensitive silver halide. The hardening developers of the invention are particularly suitable for rapidly developing radiographic elements at elevated temperatures. Such radiographic elements utilize silver bromide or silver bromide-iodide. The emulsions can be chemically sensitized by conventional procedures. The radiographic elements can include emulsion stabilizers, fog inhibiting compounds, development accelerators, hardening agents, wetting agents, plasticizers, light screening dyes and other addenda. Characteristics of various hardenable photographic elements are described in U.S. Pat. No. 4,078,932 which is incorporated herein by reference.

Examples of suitable X-ray films, for use with the developer of the invention, include T-MAT G, a high-contrast orthochromatic film for general radiography; Min-R E, a high-contrast single emulsion orthochromatic x-ray film designed for extended cycle processing in mammography applications; XJB, a blue-sensitive, medium speed, high contrast film for general radiographic procedures; and Ektascan HN, a single-coated high resolution, extremely fine-grained film for recording images with red light sources such as lasers.

The following Examples and Comparative Examples are presented to further illustrate some preferred modes of practice of the method of the invention. Unless otherwise indicated, all starting materials were commercially obtained. In the tables below, "Ex" and "Com Ex" represent Example and Comparative Example, respectively; "Dev. type" is the developer type (1 or 2) as disclosed in Table 1; "HQ loss (g/week) is hydroquinone loss in grams per week;

HYDROQUINONE DETERMINATION

Hydroquinone was determined by reversed-phase high-performance liquid chromatography with spectrophotometric detection. An isocratic separation was performed using a Supelco LC-18-DB chromatographic column, a Waters Model 510 dual-piston pump, a Waters Model 440 ultraviolet detection system, a Waters WISP Model 710B injector equipped with a 15 microliter sample loop, and a Waters Model 840 chromatographic data system. The detector performed at 254 nm and had a detector sensitivity of 0.005 AUFS. The column had a mobile phase that consisted of 0.04M ammonium acetate, 2.2 mM sodium heptane sulfonate, 130 mL/L acetonitrile. The flow rate of the mobile phase was 1.2 mL/min.

Three calibration standards were prepared which contained 9.90 g/L Anti-Calcium No. 4, 3.20 g/L Anti-Calcium No. 8, 3.00 g/L sodium bromide, 47.4 g/L 75 percent phosphoric acid, 137 g/L 45 percent potassium hydroxide, 70 g/L sodium metabisulfite, and 50 g/L sodium hydroxide and the concentrations of hydroquinone, Phenidone (1-phenyl-3-pyrazolidinone), and Dimezone-S (4,4-dimethyl-l-phenyl-3-pyrazolidinone) shown in Table 1.

TABLE 1

| Standard | Hydroquinone (g/L) | Phenidone (g/L) | Dimezone-S (g/L) |
|---|---|---|---|
| 1 | 5 | 0.5 | 2.25 |
| 2 | 25 | 1.5 | 1.25 |
| 3 | 45 | 2.5 | 0.25 |

Individual samples of developers and the standards were diluted by a factor of 20 with a solution consisting of 0.04M ammonium acetate, 2.2 mM sodium heptane sulfonate, 130 mL/L acetonitrile, and 0.6 mM ascorbic acid and were injected into the column. Hydroquinone eluted at approximately 2 minutes, Phenidone at approximately 9 minutes, and Dimezone-S at approximately 10 minutes. After Dimezone-S eluted, a mobile phase consisting of 0.016M ammonium acetate 0.88 mM sodium heptane sulfonate, and 650 ml/L acetonitrile was run for 3 minutes. The column was then equilibrated with the original mobile phase for 3 minutes. Results were determined by comparing the areas of the chromatographic peaks to the peak areas resulting from analysis of the calibration standards. The concentration of hydroquinone in the photoprocessing developer samples was calculated from the chromatographic peak area by use of a linear regression equation calculated using the standards immediately bracketing each set of samples.

SENSITOMETRIC DETERMINATIONS

Film samples were exposed with a sensitometer using a conventional 21 step exposure, followed by processing in a Kodak M6RA Processor TM with a developer temperature of 35° C. and a 23 second development time. Conventional density vs. log E curves were evaluated using a densitometer. Density measurements from the exposure steps were plotted against the relative exposure to generate characteristic curves. Speed was determined by the exposure required to produce a density of 1.00 above the base plus fog of the films, using the equation: Speed = 100(3 − log E). Base plus fog is the optical density of the film plus fog, the density of the emulsion layers in areas that were not intentionally exposed. Tabulated fog densities represent measured base plus fog densities less published base densities. Contrast was calculated from the slope of the characteristic curve between densities of 2.00 and 0.25 above the base plus fog. $D_{max}$ was a measure of the highest optical density for the exposed and processed film strip.

EXAMPLES 1-5

In Examples 1-5, Type 1 or 2 developers were prepared by mixing together the ingredients indicated in Table 2 with sequestrants as indicated in Table 3.

TABLE 2

| Ingredient | Developer Type 1 | Developer Type 2 |
|---|---|---|
| potassium sulfite | 60.1 | 57.3 |
| potassium hydroxide | 19.5 | 21.0 |
| sodium sulfite | 11.7 | 4.9 |
| sodium bicarbonate | 10.0 | 10.0 |
| hydroquinone | 22.0 | 25.0 |
| 1-phenyl-3-pyrazolidone | 1.35 | 1.25 |
| diethylene glycol | 10.0 | 10.0 |
| 5-nitroindazole | 0.127 | 0.050 |
| 5-methylbenzotriazole | 0.06 | 0.18 |

TABLE 2-continued

| Ingredient | Developer Type 1 | Developer Type 2 |
|---|---|---|
| glutaraldehyde | 4.4 | 3.1 |
| acetic acid | 4.4 | 6.3 |
| potassium bromide | 0.0 | 5.8 |
| sequestrant | 2.1 | 2.1 |

TABLE 3

| Ex | Sequestrant Monomer A | Sequestrant Monomer B | Dev Type | HQ loss (g/week) |
|---|---|---|---|---|
| 1 | itaconic | methacrylic | 1 | 1.9 |
| 2 | citraconic | methacrylic | 1 | 2.1 |
| 3 | aconitic | methacrylic | 1 | 1.8 |
| 4 | maleic | acrylic | 1 | 1.8 |
| 5 | maleic | acrylic | 2 | 0.9 |

Sequestrants utilized were —$(AB)_n$— type carboxylic acid oligomers. "A" and "B" monomer units are identified in Table 3 along with molecular weights. Developer solutions were added to open one-liter graduated cylinders at room temperature and iron was added to provide a final concentration of 3 parts per million (ppm). Developers were sampled at 36, 48, and 84 days and hydroquinone concentrations were determined as above-described. The slope of hydroquinone loss over time was estimated graphically and is reported in Table 3 as "HQ loss" in grams per week.

Comparative Examples 1-8

Developers were prepared and evaluated as in Examples 1-5, with the exception that the developer types and sequestrants used were as indicated in Table 4. The concentration of sequestrant in the developers of Comparative Examples 1-8 was 4 mMolar.

TABLE 4

| Com Ex | Sequestrant | Dev. Type | HQ loss (g/week) |
|---|---|---|---|
| 1 | iminodiacetic acid (IDA) | 1 | 2.1 |
| 2 | methyliminodiacetic acid (MIDA) | 1 | 2.5 |
| 3 | hydroxyethyliminoacetic acid (HIDA) | 1 | 2.4 |
| 4 | carboxyethyliminodiacetic acid (CIDA) | 1 | 2.9 |
| 5 | nitrilotriacetic acid (NTA) | 1 | 2.5 |
| 6 | ethylenediaminetetraacetic acid (EDTA) | 1 | 4.3 |
| 7 | diethylenetriaminepentaacetic acid (DTPA) | 1 | 2.7 |
| 8 | diethylenetriaminepentaacetic acid (DTPA) | 2 | 0.9 |

EXAMPLES 6-10

In Examples 6-10, type 1 and 2 developers were prepared as in Examples 4 and 5 (using maleicacrylic oligomer sequestrant) and were used to process commercial films in a Kodak M6RA Processor as indicated in Table 5. Development temperature was 35° C. and development time was 23 seconds. Sensitometric analyses were conducted as above-described. Results appear in Table 5.

Comparative Examples 9-13

In Comparative Examples 9-13, developers were prepared, analyses were conducted, and results are presented as in Examples 6-10, respectively, with the exception that 4 mmoles/liter of diethylenetriamine pentaacetic acid was added to each developer in place of maleic-acrylic oligomer sequestrant.

TABLE 5

| Ex or Com Ex | Dev. Type | Film | Fog | Speed | Contrast | Dmax |
|---|---|---|---|---|---|---|
| Ex 6 | 1 | T-MAT G | 0.23 | 442 | 3.00 | 3.66 |
| Com Ex 9 | 1 | T-MAT G | 0.23 | 442 | 3.01 | 3.67 |
| Ex 7 | 1 | XJB | 0.24 | 496 | 2.43 | 3.33 |
| Com Ex 10 | 1 | XJB | 0.24 | 496 | 2.43 | 3.32 |
| Ex 8 | 2 | XJB | 0.22 | 492 | 2.33 | 3.24 |
| Com Ex 11 | 2 | XJB | 0.21 | 490 | 2.37 | 3.31 |
| Ex 9 | 1 | Min-R E | 0.18 | 427 | 3.24 | 3.71 |
| Com Ex 12 | 1 | Min-R E | 0.17 | 426 | 3.29 | 3.87 |
| Ex 10 | 1 | Ektascan HN | 0.18 | 287 | 1.81 | 2.84 |
| Com Ex 13 | 1 | Ektascan HN | 0.17 | 287 | 1.80 | 2.82 |

While specific embodiments of the invention have been shown and described herein for purposes of illustration, the protection afforded by any patent which may issue upon this application is not strictly limited to a disclosed embodiment; but rather extends to all modifications and arrangements which fall fairly within the scope of the claims which are appended hereto:

What is claimed is:

1. An alkaline, aqueous black-and-white photographic developer comprising hydroquinone developing agent, auxiliary developing agent, dialdehyde hardener, organic antifoggant, sulfite antioxidant, buffer, and sequestering agent selected from the group consisting of oligomeric carboxyl substituted hydrocarbons, said hydrocarbons each having at least one subunit having the general structure:

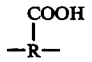

and at least one subunit having the general structure:

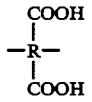

wherein said R groups each independently represent an unsubstituted alkyl group having from 2 to 4 carbons.

2. The developer of claim 1 wherein said developer has a pH from 9 to 11.

3. The developer of claim 1 wherein said organic antifoggant is selected from the group consisting of indazole antifoggants, benzimidazole antifoggants, and benzotriazole antifoggants.

4. A method for developing exposed silver halide photographic material, said method comprising developing said photographic material with the developer of claim 1.

5. The method of claim 4 wherein said developer further comprises a hydroquinone developing agent, an auxiliary developing agent selected from the group consisting of 3-pyrazolidinones and aminophenols, a dialdehyde hardener, at least one antifoggant selected from the group consisting of indazole antifoggants, benzimidazole antifoggants, and benzotriazole antifoggants, a sulfite antioxidant, a buffering agent, and a sequestering agent selected from the group consisting of oligomers having repeating units having the general structure

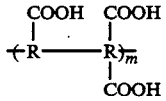

wherein

R is ethyl, propyl, or butyl, and m is from 1 to 10.

6. The method of claim 5 wherein said sequestering agent is selected from the group consisting of $-(AB)_n-$ type oligomers, wherein A is a repeating unit selected from the group consisting of

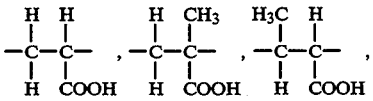

and

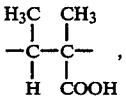

and B is a repeating unit selected from the group consisting of

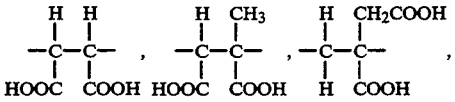

and

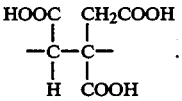

7. The method of claim 6 wherein said hydroquinone developing agent is selected from the group consisting of hydroquinone, t-butylhydroquinone, methylhydroquinone, dimethylhydroquinone, chlorohydroquinone, dichlorohydroquinone, bromohydroquinone, isopropylhydroquinone, 1,4-dihydronaphthalene, methoxyhydroquinone, ethoxyhydroquinone, hydroquinone monosulfonate, and hydroquinone disulfonate;

said auxiliary developing agent is selected from the group consisting of 1-phenyl-3-pyrazolidinone, 1-phenyl-4-phenyl-3-pyrazolidinone, 1-phenyl-4,4-dimethyl-3-pyrazolidinone, 1-phenyl-4-methyl-3-pyrazolidinone, 1-phenyl-5-methyl-3-pyrazolidinone, 4-methyl-1-phenyl-3-pyrazolidinone, 4,4'-dimethyl-1-phenyl-3-pyrazolidinone, o-aminophenol, p-aminophenol, N-methyl-p-aminophenol, N-methyl-o-aminophenol, and 2,4-diaminophenol;

said dialdehyde hardener is selected from the group consisting of aliphatic dialdehydes having aldehyde functional groups separated by a chain of 2–3 carbons or 2–3 carbons and an oxygen linkage;

said antifoggant is selected from the group consisting of 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-(2-mercapto-1,3,4-thiadiazol-2-yl-thio)-butanesulfonate, 5-amino-1,3,4-thiadiazole-2-thiol, 5-methylbenzotriazole, 1-phenyl-5-mercaptotetrazole, and benzotriazole;

said sulfite antioxidant is selected from the group consisting of sulfites, bisulfites, metabisulfites, and aldehyde-bisulfite adducts; and said buffer includes a buffering agent selected from the group consisting of carbonates, boric acid, borate salts, and alkanolamines; and an alkaline agent selected from the group consisting of KOH, NaOH, LiOH, and sodium and potassium carbonates; and wherein the buffering agent has a molar ratio relative to sulfite ions supplied by said sulfite antioxidant of greater than 0.5:1.

8. An alkaline, aqueous black-and-white photographic developer for radiographic materials comprising a hydroquinone developing agent, an auxiliary developing agent selected from the group consisting of 3-pyrazolidinones and aminophenols, a dialdehyde hardener, at least one antifoggant selected from the group consisting of indazole antifoggants, benzimidazole antifoggants, and benzotriazole antifoggants, a sulfite antioxidant, a buffering agent, and a sequestering agent selected from the group consisting of oligomers having repeating units having the general structure

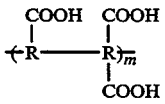

wherein

R is ethyl, propyl, or butyl, and m is from 1 to 10.

9. The developer of claim 8 wherein said sequestering agent is selected from the group consisting of $-(AB)_n-$ type oligomers, wherein A is a repeating unit selected from the group consisting of

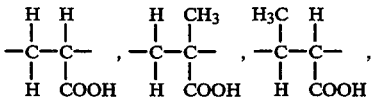

and

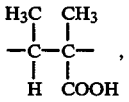

and B is a repeating unit selected from the group consisting of

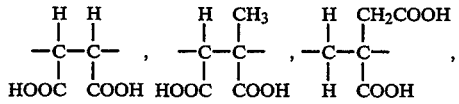

and

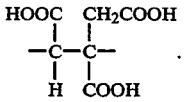

10. The developer of claim 9 wherein said hydroquinone developing agent is selected from the group consisting of hydroquinone, t-butylhydroquinone, methylhydroquinone, dimethylhydroquinone, chlorohydroquinone, dichlorohydroquinone, bromohydroquinone, isopropylhydroquinone, 1,4-dihydronaphthalene, methoxyhydroquinone, ethoxyhydroquinone, hydroquinone monosulfonate, and hydroquinone disulfonate.

11. The developer of claim 9 wherein said auxiliary developing agent is selected from the group consisting of 1-phenyl-3-pyrazolidinone, 1-phenyl-4-phenyl-3-pyrazolidinone, 1-phenyl-4,4-dimethyl-3-pyrazolidinone, 1-phenyl-4-methyl-3-pyrazolidinone, 1-phenyl-5-methyl-3-pyrazolidinone, 4-methyl-1-phenyl-3-pyrazolidinone, 4,4'-dimethyl-l-phenyl-3-pyrazolidinone, o-aminophenol, p-aminophenol, N-methyl-p-aminophenol, N-methyl-o-aminophenol, and 2,4-diaminophenol.

12. The developer of claim 9 wherein said dialdehyde hardener is selected from the group consisting of aliphatic dialdehydes having aldehyde functional groups separated by a chain of 2–3 carbons or 2–3 carbons and an oxygen linkage.

13. The developer of claim 9 wherein said dialdehyde hardener is selected from the group consisting of glutaraldehyde, α-methylglutaraldehyde, β-methylglutaraldehyde, maleic dialdehyde, succindialdehyde, methylsuccindialdehyde, methoxysuccindialdehyde, α-butoxy-glutaraldehyde, α-methyl-β-ethoxyglutaraldehyde, α-methoxy-β-ethoxyglutaraldehyde, α-n-butoxyglutaraldehyde, α,α-dimethylglutaraldehyde, α,α-dimethoxysuccindialdehyde, β-isopropylsuccindialdehyde, α,α-diethylsuccindiaidehyde, butylmaleic dialdehyde, and β-isopropoxysuccindialdehyde.

14. The developer of claim 9 wherein said antifoggant is selected from the group consisting of 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-(2-mercapto-1,3,4-thiadiazol-2-yl-thio)butanesulfonate, 5-amino-1,3,4-thiadiazole-2-thiol, 5-methylbenzotriazole, 1-phenyl-5-mercaptotetrazole, and benztriazole.

15. The developer of claim 9 wherein said sulfite antioxidant is selected from the group consisting of sulfites, bisulfites, metabisulfites, and aldehyde-bisulfite adducts.

16. The developer of claim 9 wherein said buffer includes a buffering agent selected from the group consisting of carbonates, boric acid, borate salts, and alkanolamines; and an alkaline agent selected from the group consisting of KOH, NaOH, LiOH, and sodium and potassium carbonates; and wherein the buffering agent has a molar ratio relative to sulfite ions supplied by said sulfite antioxidant of greater than 0.5:1.

17. The developer of claim 16 wherein said molar ratio is from 1:1 to 2:1.

18. The developer of claim 9 being further characterized as including potassium sulfite, potassium hydroxide, sodium sulfite, sodium bicarbonate, hydroquinone, 1-phenyl-3-pyrazolidone, diethylene glycol, 5-nitroindazole, 5-methylbenzotriazole, glutaraldehyde, and acetic acid.

19. The developer of claim 18 being further characterized as including potassium bromide.

20. The developer of claim 9 wherein A is the repeating unit

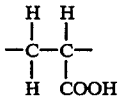

and B is the repeating unit

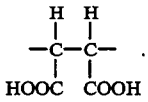

* * * * *